US008715422B2

(12) United States Patent
Leslie

(10) Patent No.: US 8,715,422 B2
(45) Date of Patent: May 6, 2014

(54) SHOE SOLE CLEANING SYSTEM AND METHOD

(76) Inventor: Peter W. Leslie, Ormond Beach, FL (US)

( * ) Notice: Subject to any disclaimer, the term of this patent is extended or adjusted under 35 U.S.C. 154(b) by 84 days.

(21) Appl. No.: 13/564,471

(22) Filed: Aug. 1, 2012

(65) Prior Publication Data

US 2013/0185878 A1 Jul. 25, 2013

Related U.S. Application Data

(60) Provisional application No. 61/589,630, filed on Jan. 23, 2012.

(51) Int. Cl.
*A47L 23/04* (2006.01)

(52) U.S. Cl.
USPC ..... 134/6; 15/104.92; 15/257.01

(58) Field of Classification Search
USPC ..... 15/97.2, 104.92, 257.01; 134/6
See application file for complete search history.

(56) References Cited

U.S. PATENT DOCUMENTS

| | | | | |
|---|---|---|---|---|
| 3,648,322 | A * | 3/1972 | Meisner | 15/257.05 |
| 4,275,970 | A * | 6/1981 | Morrison et al. | 401/6 |
| 2005/0071942 | A1 * | 4/2005 | Akhtar | 15/257.01 |

* cited by examiner

*Primary Examiner* — Randall Chin
(74) *Attorney, Agent, or Firm* — Dale J. Ream

(57) ABSTRACT

A shoe sole cleaning device includes a housing for storing a plurality of sanitation wipes therein. The cleaning apparatus includes a separation platform for supporting a scrubbing member thereon and a plurality of displacement pins coupled to the platform. The pins are positioned and configured to force a portion of a sanitation wipe into a corresponding retention member coupled with a scrubbing pad of a hand-held scrubbing member. There is also provided a lid that atmospherically seals the cleaning system to prevent evaporation and drying of the plurality of sanitation wipes.

19 Claims, 7 Drawing Sheets

SHOE SOLE CLEANING SYSTEM AND METHOD

CROSS-REFERENCE TO RELATED APPLICATIONS

This non-provisional patent application claims the benefit of provisional application Ser. No. 61/589,630 filed on Jan. 23, 2012, titled Shoe Sole Cleaning System and Method.

FIELD OF THE INVENTION

The present invention relates generally to shoe sole cleaning devices. More particularly, the present invention relates to a shoe sole cleaning device that employs a disposable sanitizing wipe coupled to a handheld scrubbing member for use in cleaning and sanitizing the soles of shoes.

BACKGROUND OF THE INVENTION

Historically, it has been common practice for many cultures and communities to require people to either clean their shoes before entering a house, places of worship, business or request that the person remove their shoes entirely before entering. Correspondingly, as men, women, and children return home after walking in super markets, drug stores, public restrooms, parking lots, streets, alleys, driveways, playgrounds, and outdoor sport surfaces, they arrive with soiled, contaminated and nearly black shoe soles. In other conditions, many people have to cope with sand, mud, or other debris on their shoe or boot soles. Thus, it is common that the soiled/contaminated soles track this residue into homes, places of worship, businesses etc. resulting in the staining/contaminating of carpet, rugs, tile, upholstered furniture or combinations thereof. In response, some people try to avoid staining/contaminating such interior surfaces by removing their shoes before they enter the house. At this point, they have to decide whether to leave their shoes outside, pile them in a corner inside the house, carry them inside and wash the soles in a sink, or throw them in a washing machine every day. Understandably, none of these measures is very popular or convenient.

Over time numerous shoe sole cleaning devices have been invented and while somewhat useful in addressing the need to clean and/or sanitize shoe soles these known solutions are still lacking in availability, ease of use, efficiency etc. Moreover, many of these known solutions are very expensive, complex or not available to the average consumer. One known solution provides an athletic shoe cleaner in the form of a brush/scraper that is applied the footwear or wrist of a person. The brush/scraper is used by removing the device from the footwear/wrist and is subsequently used to dislodge large particles/debris adhered to the sole. This known solution, while somewhat useful, presents significant drawbacks. Initially, the use of a brush to scrub the sole of a shoe is well known throughout history and is somewhat effective in removing contaminants therefrom. However, the scrubbing requires vigorous physical action by the user and frequently scatters the debris in every direction thus contaminating the local vicinity. Additionally, the use of this known solution does not adequately sterilize or reduce contaminants that may be present on the sole.

Another known solution in the prior art provides a shoe sole sanitizing device that is made up of a tray having a reservoir containing a sanitizing solution, a perforated grate with scraping edges on the tray being of a resiliency sufficient to be depressed beneath the upper surface of the solution when stepped on by a wearer. A drain is provided in the reservoir for removal of used solution and particles which collects in therein. In one version, an automated fluid fill and drain system may be mounted within the tray, or mounted on the tray. This known solution, while somewhat useful, presents significant drawbacks. One deficiency is that the overall form-factor and/or size of the device is intrusive and requires a dedicated area for use. In the version where an automated fluid fill/drain device is employed, the device becomes exponentially more complex and expensive due to the additional plumbing and meeting any regulatory requirements for disposal of the cleaning solution. Finally, the device saturates the sole of the shoe, and possibly the shoe upper, which results in a longer drying time.

In the prior art there is another known solution that provides a sole cleaning and drying device mainly for removing the dark residue that clings to shoe and boot soles after walking and playing on some types of asphalt paving. This box apparatus can be used for various types and sizes of shoes, allowing people to clean and dry both soles in just a few minutes without having to remove their shoes. The device contains high pile, thick tufted carpet pieces on contiguous sturdy basis that serve as the cleaner and dryer elements, working well on a variety of sole indentations. Used with liquid cleaner and a little water, this arrangement allows fast and easy procedures for effectively cleaning shoe and boot soles. A simple attachment to the box holds the lid up while the soles are being cleaned, then closes for better appearance and security. This known solution, while somewhat useful, presents significant drawbacks. Primarily, this solution is a combination of the two previously described solutions, as suffers from the deficiencies of both. To begin, the use of a brush or tufted material scatters debris over adjacent areas. This device also requires a substantial area that is dedicated to the use of the device and is rather unsightly to the common observer. Finally, this known solution, when used with a liquid cleaner and water combination is likely to over-saturate the sole, and possibly the shoe upper, resulting in a soaked shoe that requires excessive drying time.

Efforts to provide a shoe sole cleaning system and method have not met with significant success to date. As a result, there is a need in the art for a shoe sole cleaning system that requires minimal dedicated area, does not scatter debris in multiple directions, applies sanitizer/cleaning solution without oversaturation, and is convenient to use.

DETAILED DESCRIPTION OF THE PREFERRED EMBODIMENTS

Figure 1:
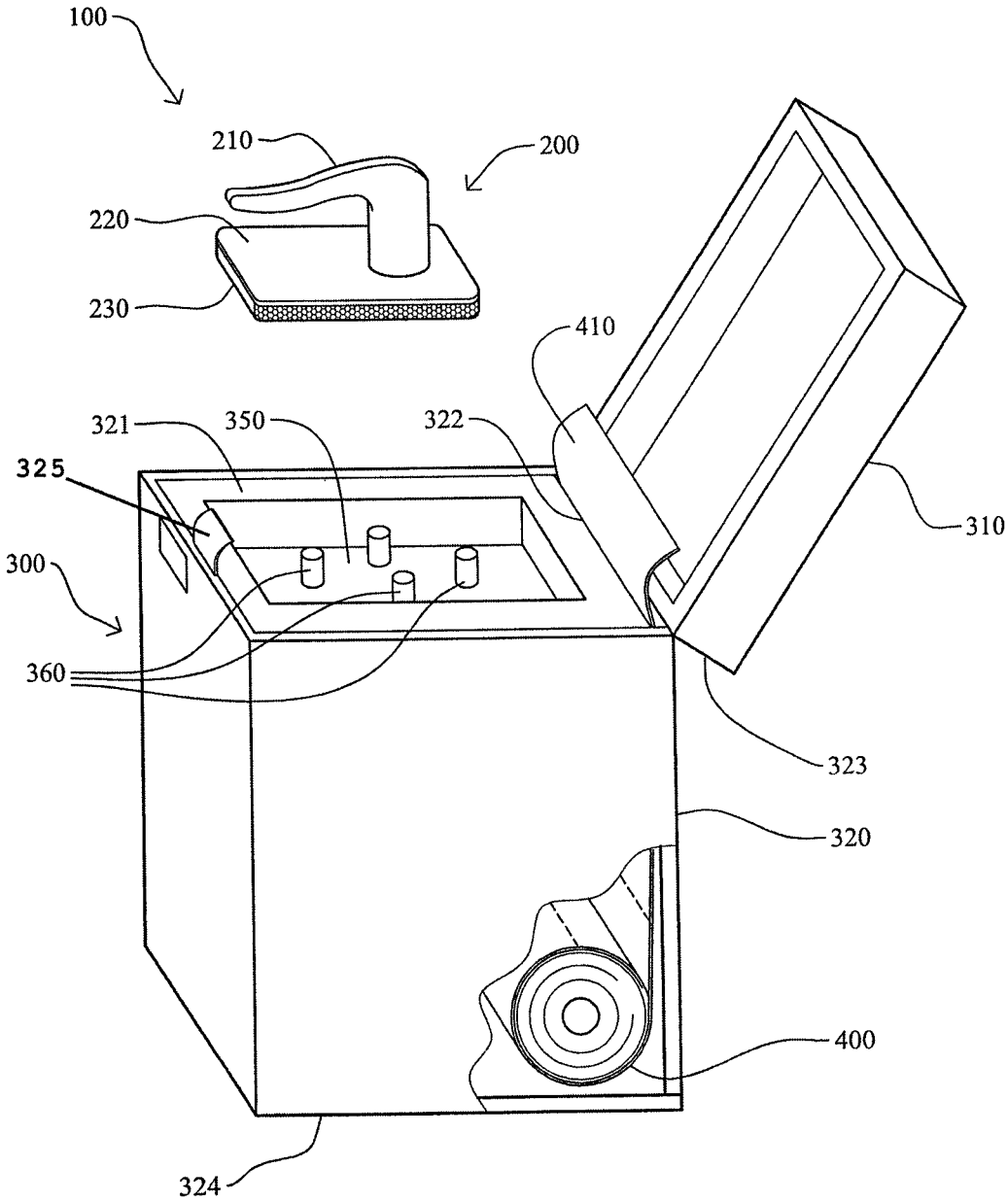
FIG. 1 is an exploded partial section isometric view of a shoe sole cleaning system according to one embodiment of the present invention but not limiting itself to this singular example.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", vertical", "horizontal", and derivatives thereof shall relate to the invention as oriented in FIG. 1.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments which may be disclosed herein are not to be considered as limiting, unless the claims expressly state otherwise.

A shoe sole cleaning system will now be described with reference to FIGS. 1 to 8 of the accompanying drawings. The shoe sole cleaning system 100 (also termed a shoe cleaning device or apparatus) includes a housing 320, a separation platform 350, and a scrubbing member 200 having retention members 240 for retaining a sanitation wipe 410.

Figure 2:
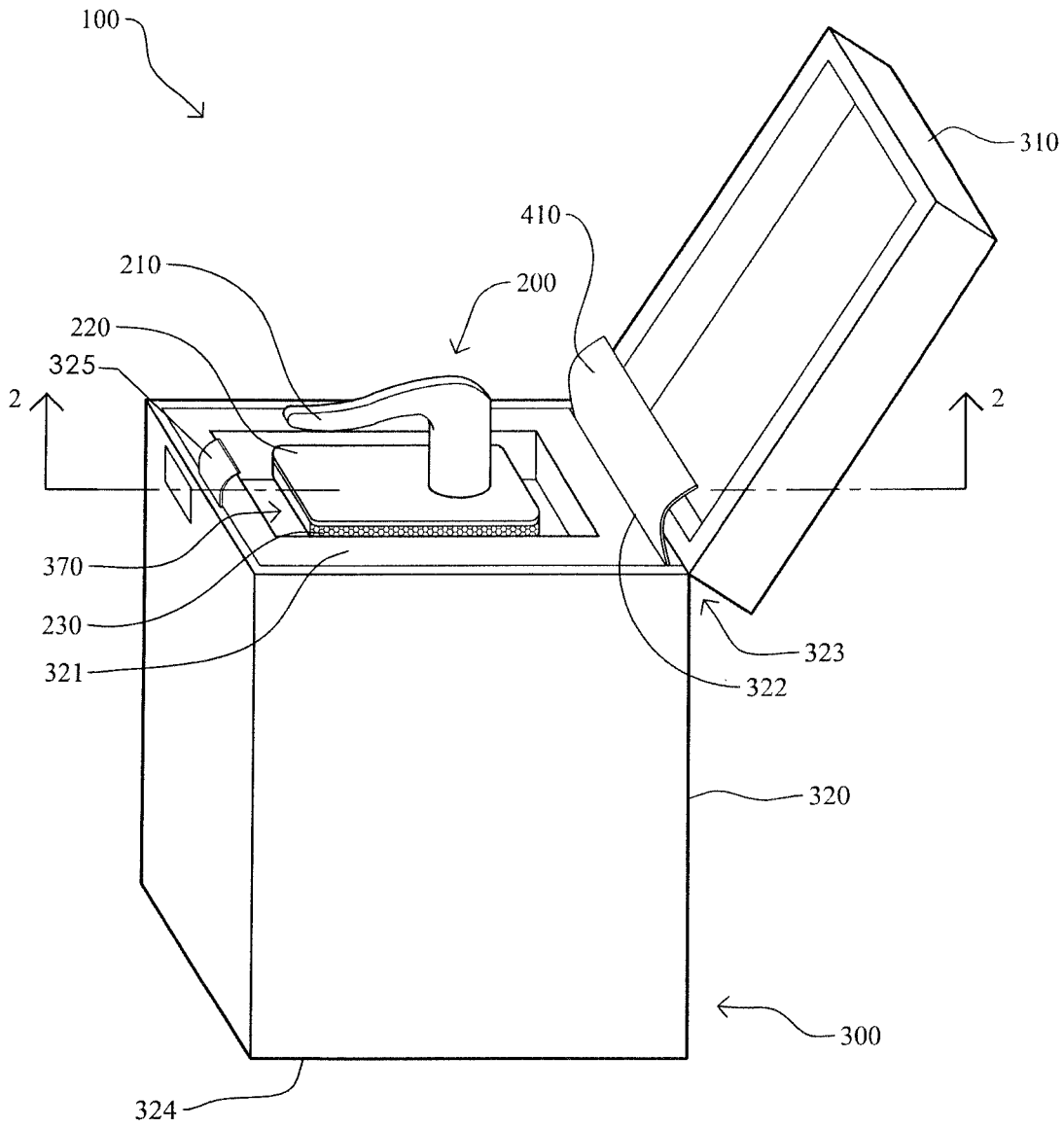
FIG. 2 is a non-exploded view of the shoe sole cleaning system as in FIG. 1 with the lid in an open position and with the scrubbing member resting on the separation platform.

Reference is now made to FIGS. 1 and 2 which illustrate a shoe sole cleaning system 100 having a scrubbing member 200, rectangular enclosure 300 and a roll of sanitation wipes 400. Scrubbing member 200 generally comprises a handle 210 coupled to a base member 220 and a scrubbing pad 230 coupled to the base member 220. Sanitation wipes 400 are contemplated to comprise a contiguous roll of perforated disposable sanitary cleansing wipes. Each sanitation wipe 410 is preferably fabricated from an absorbent material suitable for fluid saturation by a sanitizing/cleaning fluid or liquid. Sanitation wipes 400 may be a cloth such as cotton, polyester, nylon, paper, paper-composite or combinations thereof. Such wipes are well known and used in the household cleaning industry and are not described in detail so as not to obscure the invention herein.

Rectangular enclosure 300 generally comprises a lid 310 pivotally coupled to a housing 320. Contained within housing 320 is a roll of sanitation wipes 400 that are internally routed to an upper surface 321 and pass through slot 322 formed along and adjacent to a pivoting edge 323 such that an individual sanitation wipe 410 is accessible there through. Rectangular enclosure 300 further includes a separation platform 350 that is spaced apart from upper surface 321 and towards a bottom surface 324 of rectangular enclosure 300. In other words, the separation platform 350 may be situated in a recess defined by an upper surface of the housing 320. Separation platform 350 includes a plurality of displacement pins 360 that extend upwardly from the separation platform 350 towards upper surface 321. In one exemplary embodiment scrubbing member 200 fits within a recessed portion of rectangular enclosure 300 and is supported thereon by separation platform 350 such that lid 310 may be pivotally opened and closed with respect to rectangular enclosure 300. The separation platform 350 is accessible when the lid 310 is open relative to the housing 320 and access is prevented when the lid 310 is closed.

It is contemplated that rectangular enclosure 300 may be fabricated from various materials such as plastic, metal or other suitable material. The fabrication of the various elements and features of rectangular enclosure 300 may be performed by one or more well-known manufacturing processes that one of ordinary skill in the art would readily understand. These materials and processes are not described in detail so as not to obscure the teachings of the present invention. It is further contemplated that the rectangular enclosure 300 may be fabricated in various shapes, textures, colors or combinations thereof as fashionably and functionally desired.

In one exemplary embodiment, rectangular enclosure 300 generally comprises a housing 300 that is about 12" in height, 5" in width and 7" deep. The lid 310 comprises a general height of 2.75", a width of 5" and a depth of 7". In this exemplary embodiment, a corresponding scrubbing member 200 generally measures 2.75" in height, width about 2.75" and a depth of about 4". Although the disclosed exemplary embodiment employs a rectangular enclosure and scrubbing member, other geometric sizes and configurations are possible and are contemplated by the inventor such that one of ordinary skill in the art would recognize suitable alternatives within the teachings of the present invention. For instance, another embodiment of the apparatus 100 may include a housing (not shown) having a generally cylindrical configuration and a generally circular scrubbing member and contain only one roll of wipes (by contrast to the rectangular embodiment which may contain several rolls of wipes). In this alternative embodiment, a plurality of wipes may be positioned inside the housing and be withdrawn through an aperture in an upper surface of the housing.

Figure 3:
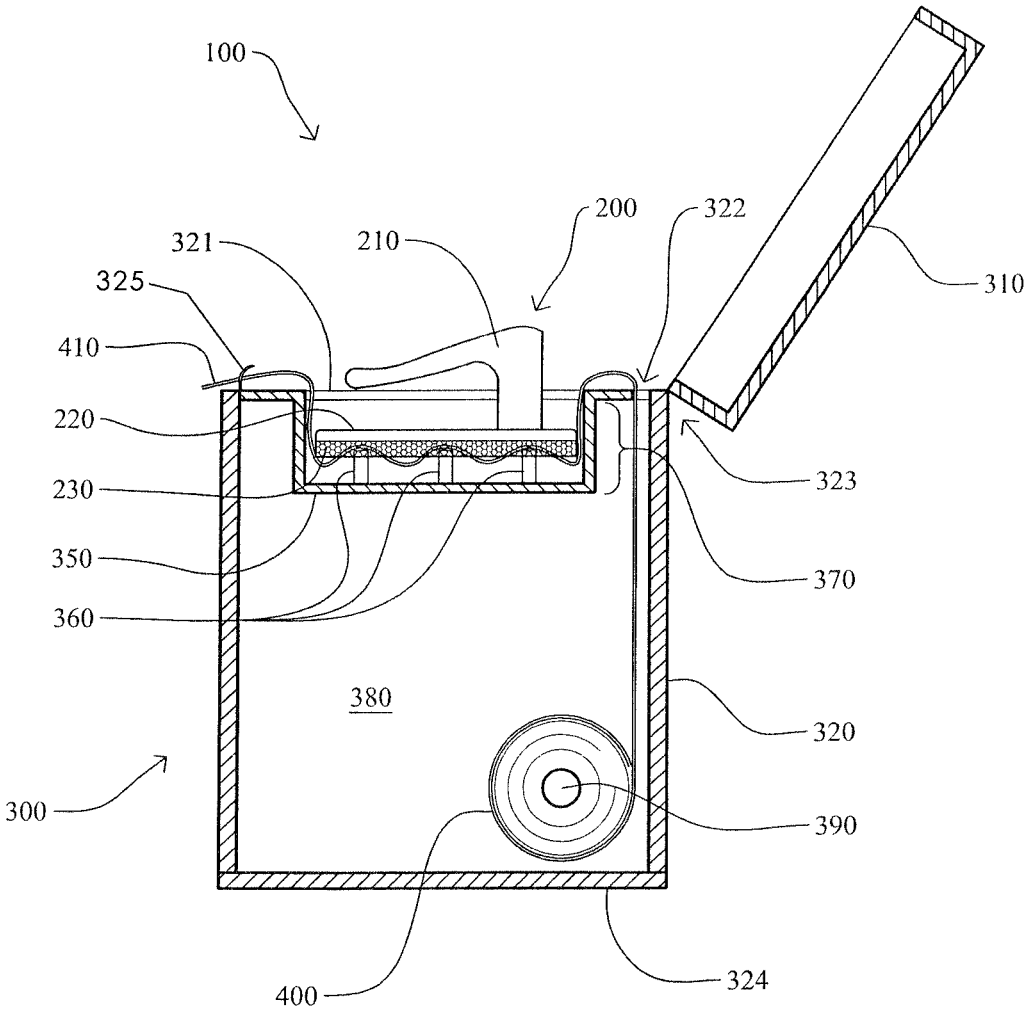
FIG. 3 is a section view taken along line 2-2 of FIG. 2 showing the scrubbing member resting on the separation platform and the roll of wipes within the container.

Attention is now directed to FIG. 3 which is a cross-sectional view of shoe sole cleaning system 100 taken along section line 2-2 of FIG. 2. In this illustration, an individual sanitation wipe 410 is drawn over upper surface 321 of rectangular enclosure 300 such that a recessed portion 370 formed by separation platform 350 is covered by the sanitation wipe 410 (see FIG. 6). Scrubbing member 200 is placed into the recessed portion 370 such that displacement pins 360 wedge a portion of sanitation wipe 410 into retention members 240 (described in greater detail below with respect to FIGS. 4 and 5) that are coupled to scrubbing pad 230. In one exemplary embodiment, scrubbing member 200 is configured to fit within recess portion 370 such that lid 310 may be closed thereby sealing rectangular enclosure 300. Additionally, upper surface 321 is contemplated to provide atmospheric sealing of an interior volumetric region 380 of housing 320 such that sanitation wipes 400 are substantially prevented from drying out. It is contemplated that displacement pins 360 may be integrally formed with separation platform 350 and are configured to push a portion of sanitation wipe 410 into the retention member 240 of scrubbing pad 230 without tearing or puncturing the sanitation wipe 410. This may be accomplished by rounding the top end of the displacement pins 360 or by coupling a protective sleeve, such as screw protector, over the top end. Further, it is contemplated that upper surface 321 and separation platform 350 may be integrally formed together and releasably coupled to housing 320 such that a user may access the interior volumetric region 380 to replenish a spent roll of sanitation wipes 400. In one exemplary embodiment, displacement pins 360 are geometrically aligned with a corresponding retention member of scrubbing member 200 such that each pin substantially extends into the retention member 240.

In an alternate embodiment (not shown), interior volumetric region 380 may also contain multiple rolls of sanitation wipes 400. The sanitation wipes 400 may be rotationally coupled within housing 320 by rod 390 which passes through a center opening in the roll of sanitation wipes 400. An alternate exemplary embodiment may permit the roll of sanitation wipes 400 to rotate freely within the interior volumetric region 380.

Figure 4:
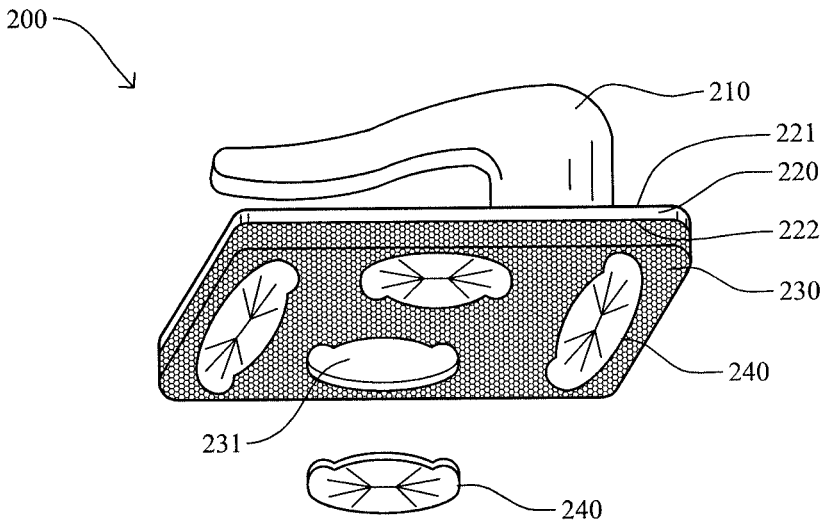
FIG. 4 is an exploded view of the scrubbing member showing a handle portion and a scrubbing pad.
Figure 5:
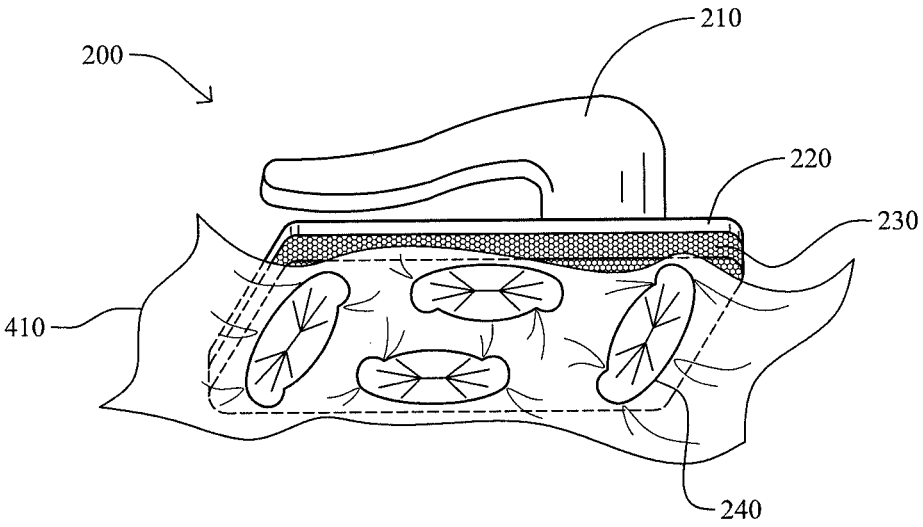
FIG. 5 is a non-exploded view of FIG. 4 further including a disinfectant wipe positioned below the scrubbing member.

A partially exploded lower isometric view of scrubbing member 200 is provided in FIG. 4. Scrubbing member 200 includes a handle 210 coupled to an upper surface 221 of base member 220 and operatively extending therefrom. Base member 220 includes a lower surface 222 to which is coupled scrubbing pad 230. The scrubbing pad 230 may be configured with one or more recesses 231 into which retention member 240 may be operatively coupled. In one exemplary embodiment, retention member 240 generally comprises a rubberized multi-point push/hold gripping element such as those commonly found on household dust mops. Retention member 240 may provide for releasable retention of sanitation wipe 410 such that a user may conveniently couple for use and then remove the soiled sanitation wipe 410 after use. In another exemplary embodiment, scrubbing pad 230 may be fabricated from a sponge material, an applicator brush, a pliant scouring pad or combinations thereof. Shown in FIG. 5, is a non-exploded view of FIG. 4 further including a sanitation wipe 410 operatively coupled with scrubbing member 200. As can be seen in this figure, a portion of sanitation wipe 410 may be forced into retention member 240 such that the sanitation wipe 410 is retained with respect thereto and effectively covers the exposed area of scrubbing pad 230. Additionally, a portion of sanitation wipe 410 is readily accessible at each end of the scrubbing member 200 such that a user may grasp one end and remove a soiled sanitation wipe 410 therefrom.

In still another exemplary embodiment (not shown), the separation platform 350 may be constructed without the displacement pins 360. Correspondingly, the lower surface of the scrubbing member 200 may not include retention members 240. Instead, an upper surface of the scrubbing member 200 may include retention members into which a sanitation wipe may be held, such as by being inserted therein by the fingers of a user. In this way, a wipe may be coupled to respective retention members, extended beneath the scrubbing member pad, and again coupled to respective retention members positioned atop the scrubbing member 200.

Figure 6:
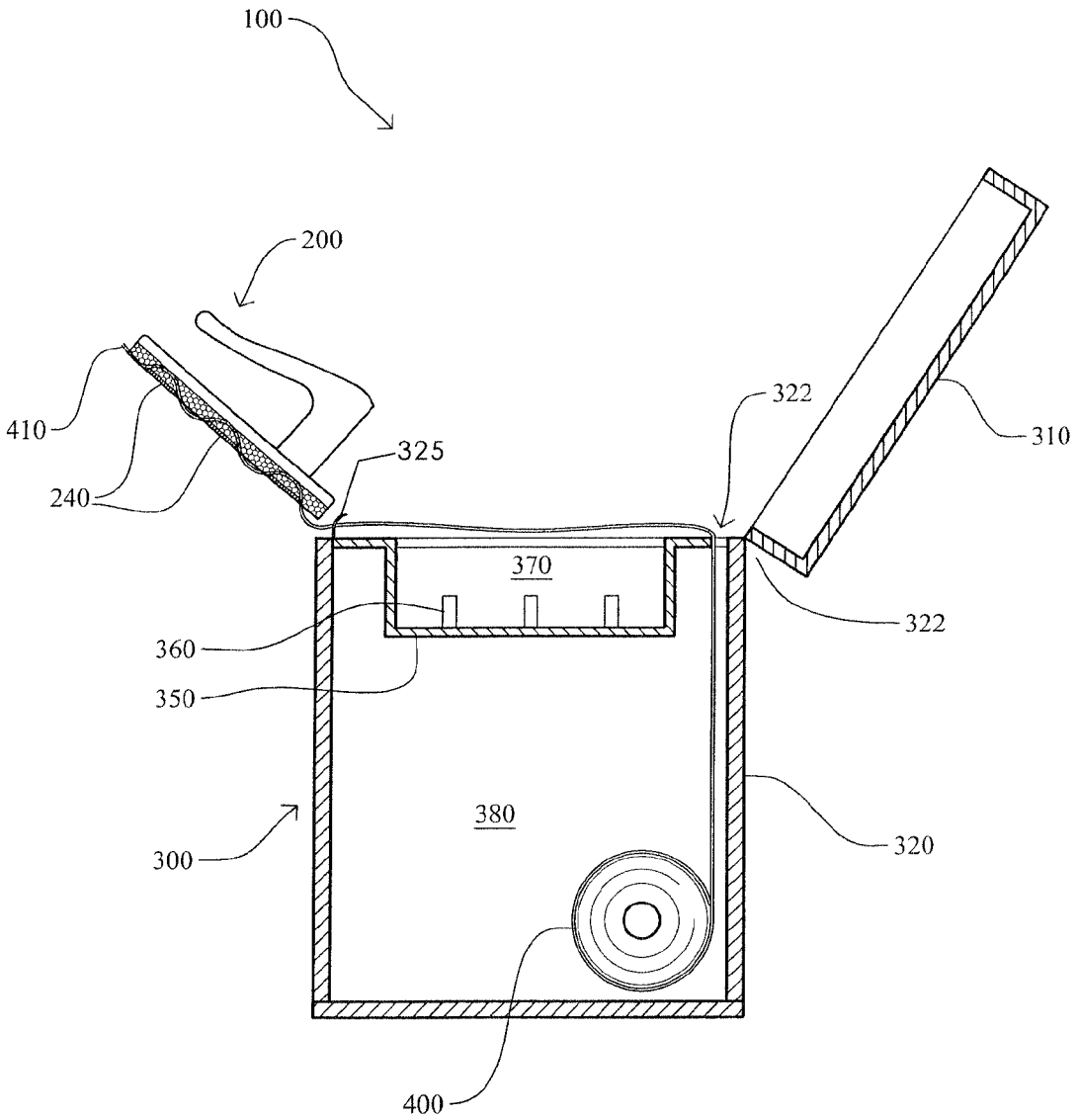
FIG. 6 is a side view showing the scrubbing member and attached disinfectant wipe being removed from the shoe sole cleaning system and positioning a seam of the wipe over a lid tear tab.
Figure 7:
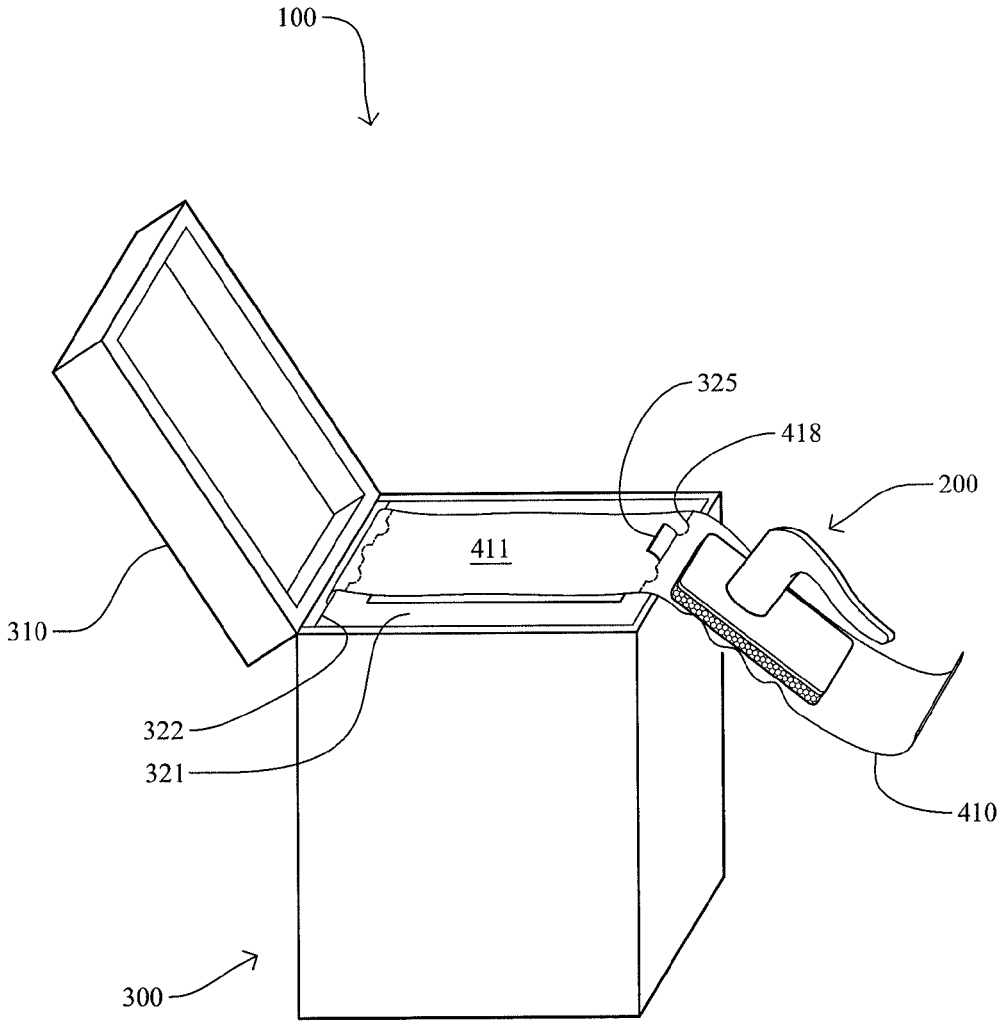
FIG. 7 is an isometric view of FIG. 6 further showing a disinfectant wipe coupled to the scrubbing member and a perforated seam positioned for separation by the user.

In operation and referring to FIGS. 2, 6 and 7, the shoe sole cleaning system 100 is deployed by opening lid 310 of rectangular enclosure 300 and removing scrubbing member 200 which is stored in recess portion 370. A free end of sanitation wipe 410 is pulled and drawn across recess portion 370 such that the sanitation wipe 410 covers displacement pins 360. Scrubbing member 200 is then proximately located above and aligned with recess portion 370 such that displacement pins 360 are operationally positioned with respect to retention members 240. Scrubbing member 200 is then pressed downward onto sanitation wipe 410 such that displacement pins 360 force a portion of sanitation wipe 410 into a corresponding retention member 240 and recess 231. Next, scrubbing member 200 is raised above recess portion 370 and further drawn along upper surface 321 such that a perforated seam 418 (see FIG. 7) is positioned upon tear tab 325 of housing 320. Scrubbing member 200 and coupled sanitation wipe 410 may now be detached from an adjacent sanitation wipe 411 and used to scrub/sanitize the soles of one or more shoes. After use, the soiled sanitation wipe 410 is removed from scrubbing member 200 by pulling disconnecting tab 430 of sanitation wipe 410 to disengage retention members 240. The sanitation wipe 400 is then discarded and scrubbing member is placed back into recess portion 370 and lid 310 is placed in the closed positioned until the next use is desired. In one exemplary embodiment, lid 310 may be sealed with respect to housing 320 by way of a releasable clasp, snap, buckle or other mechanical fastening means. Further, this exemplary embodiment may include one or more seals between upper surface 321 and lid 310 to effectuate sufficient atmospheric isolation of sanitation wipes 400 to ensure and prolong saturation of sanitation wipes 400.

Figure 8:
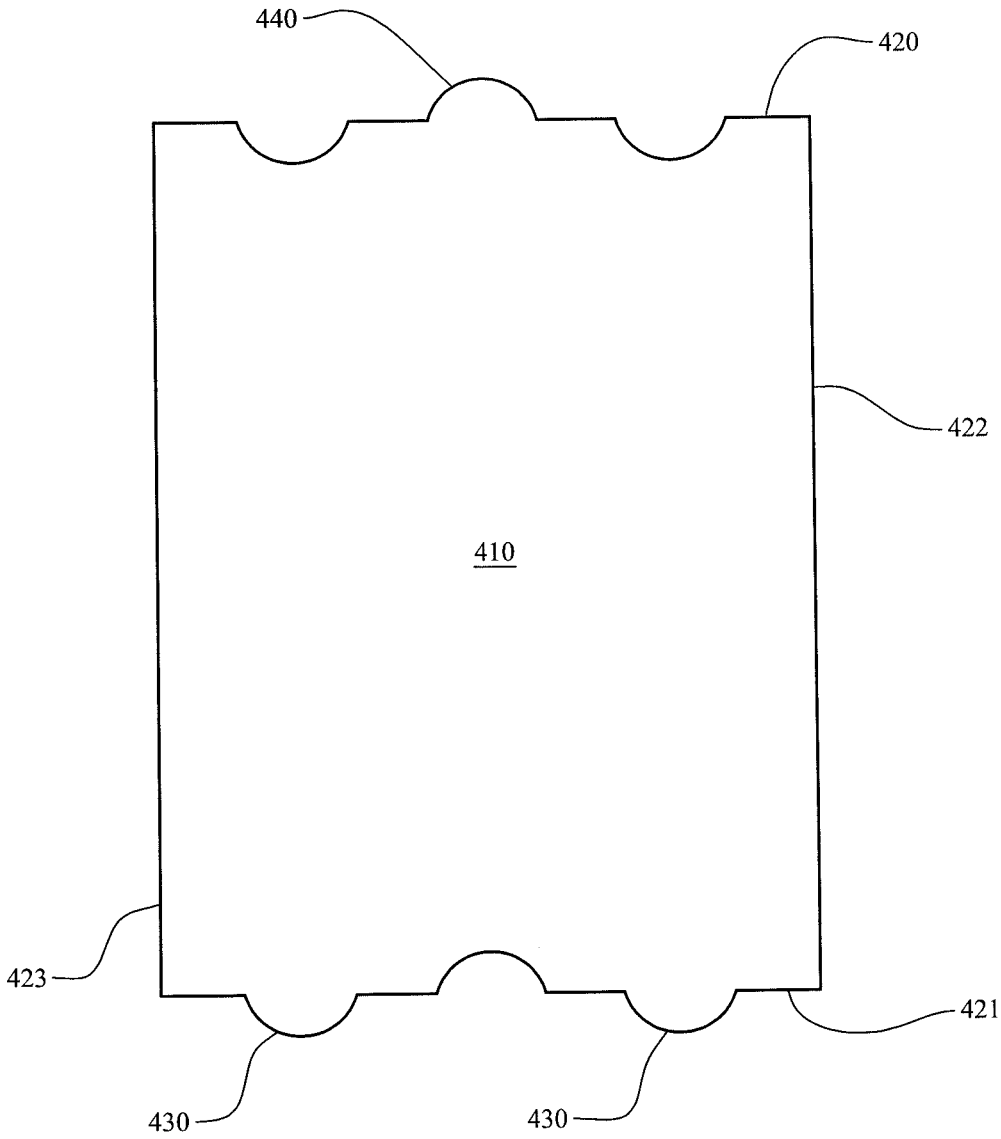
FIG. 8 is a top view of an exemplary sanitation wipe.

An exemplary sanitation wipe 410 is illustrated in FIG. 8 having an upper edge 420, a lower edge 421, a first side edge 422 and a second side edge 423. It is contemplated that sanitation wipe 410 is coupled to an adjacent sanitation wipe 411 by way of a perforated seam disposed therebetween. Further, in one exemplary embodiment, sanitation wipe 410 may measure about 4" by 5" however; other dimensions may also be suitable. Sanitation wipe 410 may include one or more disconnecting tabs 430 that extend from lower edge 421 into an upper edge 420 of an adjacent wipe. Additionally, there is provided a tear notch 440 that is formed into the lower edge 421 and extends towards the upper edge 420 of the same wipe. The tear notch 440 is configured for operative engagement with tear tab 325 of housing 320.

Although the above provides a full and complete disclosure of the preferred embodiments of the invention, various modifications, combinations, alternate constructions and equivalents will occur to those skilled in the art. It is intended that all matters in the foregoing description and shown in the accompanying drawings be interpreted as illustrative and not in a limiting sense. Therefore the above should not be construed as limiting the invention, which is defined by the appended claims and their legal equivalence.

It is understood that while certain forms of this invention have been illustrated and described it is not limited thereto notwithstanding the limitations that may be implied or included in the following claims and allowable functional equivalents thereof.

The invention claimed is:

1. A shoe sole cleaning device, comprising:

an enclosure having a housing and a lid pivotally coupled thereto, said housing having a bottom surface, an opposed upper surface, and at least one side wall extending between said bottom surface and said upper surface and configured such that said housing defines an open area therein;

a separation platform adjacent said upper surface of said housing;

at least one displacement pin extending away from said separation platform adjacent said upper surface of said housing;

a scrubbing member that includes a base member having upper and lower surfaces, said scrubbing member having a handle coupled to said scrubbing member upper surface and a scrubbing pad coupled to said scrubbing member lower surface;

wherein said scrubbing pad defines at least one scrubbing pad recess; and a retention member coupled to said scrubbing pad recess that is configured to retain a sanitary wipe therein.

2. The shoe sole cleaning device as in claim 1, wherein said upper surface of said housing defines a recess extending downwardly toward said housing bottom surface, said separation platform being positioned in said recess.

3. The shoe sole cleaning device as in claim 2, wherein said lid is movable between an open configuration enabling access to said separation platform and a closed configuration blocking access to said separation platform.

4. The shoe sole cleaning device as in claim 3, further comprising:

a plurality of disposable sanitary wipes positioned in said open area of said housing, said plurality of wipes being interconnected and contiguous; and wherein said housing upper surface defines a slot configured to receive and communicate a respective one of said plurality of wipes from inside said interior area to a position in said recess.

5. The shoe sole cleaning device as in claim 4, wherein said plurality of wipes is a roll of perforated contiguous sanitary cleaning wipes situated on said housing bottom surface in said housing open area.

6. The shoe sole cleaning device as in claim 4, wherein said scrubbing member base includes a configuration that is complementary to a configuration of said housing recess such that said scrubbing member is selectively received in said housing recess and supported on said separation platform.

7. The shoe sole cleaning device as in claim 4, wherein said enclosure is atmospherically sealed when said lid is at said closed configuration such that said plurality of wipes is substantially prevented from drying out.

8. The shoe sole cleaning device as in claim 4, wherein a respective wipe of said plurality of wipes overlays said displacement pin when said respective wipe is extended through said slot into said recess.

9. The shoe sole cleaning device as in claim 4, wherein said enclosure includes a tear tab coupled to said upper surface of said housing, said tear tab being configured to separate a respective wipe from an adjacent wipe.

10. The shoe sole cleaning device as in claim 9, wherein each of said plurality of wipes includes a perforated seam at which respective wipes may be selectively separated.

11. The shoe sole cleaning device as in claim 1, further comprising:

a plurality of disposable sanitary wipes positioned in said open area of said housing, said plurality of wipes being interconnected and contiguous;

wherein said housing upper surface defines a slot configured to receive and communicate a respective one of said plurality of wipes from inside said interior area to a position overlaying said separation platform outside of said interior area; and wherein a respective wipe of said plurality of wipes overlays said retention pin on said separation platform when said respective wipe is communicated through said slot.

12. The shoe sole cleaning device as in claim 11, wherein said plurality of wipes is a roll of perforated contiguous sanitary cleaning wipes situated on said housing bottom surface in said housing interior area.

13. The shoe sole cleaning device as in claim 11, wherein a top of said displacement pin is configured such that said respective wipe is not punctured when said scrubbing member base is positioned atop said separation platform.

14. A method for cleaning shoe soles, comprising the steps of:

providing an enclosure having a housing and a lid pivotally coupled thereto, said housing having a bottom surface, an opposed upper surface, and at least one side wall extending between said bottom and upper surface and configured such that said housing defines an open area therein, wherein said enclosure includes a separation platform adjacent said upper surface of said housing and at least one displacement pin extending away from said separation platform;

providing a scrubbing member that includes a base member having upper and lower surfaces, said scrubbing member having a handle coupled to said scrubbing member upper surface and a scrubbing pad coupled to said scrubbing member lower surface, wherein said base member lower surface defines a scrubbing member recess;

providing a retention member coupled to said scrubbing pad recess that is configured to retain a sanitary wipe therein;

removing a sanitary wipe from said housing open area and positioning said sanitary wipe atop said displacement pin; and pressing said scrubbing member base onto said displacement pin until said sanitary wipe is wedged into said scrubbing member recess.

15. The method as in claim 14, wherein:

said upper surface of said housing defines a recess extending downwardly toward said housing bottom surface, said separation platform being positioned in said recess; and said lid is movable between an open configuration enabling access to said separation platform and a closed configuration blocking access to said separation platform.

16. The method as in claim 15, wherein:

said sanitary wipe is positioned in said interior space of said housing; and said upper surface of said housing defines a slot configured to selectively receive and communicate said sanitary wipe from a position inside said interior area to a position atop said separation platform.

17. The method as in claim 16, wherein said scrubbing member base includes a configuration that is complementary to a configuration of said housing recess such that said scrubbing member is selectively received in said housing recess and supported on said separation platform.

18. The method as in claim 14, wherein said lid is movable between an open configuration enabling access to said separation platform and a closed configuration blocking access to said separation platform.

19. The method as in claim 18 wherein said enclosure is atmospherically sealed when said lid is at said closed configuration such that said plurality of wipes is substantially prevented from drying out.

* * * * *